US005968335A

United States Patent [19]

Torii et al.

[11] Patent Number: 5,968,335

[45] Date of Patent: Oct. 19, 1999

[54] PROCESS FOR PREPARING 3-ALKOXYMETHYLCEPHEM COMPOUNDS

[75] Inventors: Sigeru Torii; Hideo Tanaka, both of Okayama-ken; Michio Sasaoka; Yutaka Kameyama, both of Tokushima, all of Japan

[73] Assignee: Otsuka Kagaku Kabushiki Kaisha, Osaka, Japan

[21] Appl. No.: 08/945,850

[22] PCT Filed: Mar. 7, 1997

[86] PCT No.: PCT/JP97/00708

§ 371 Date: Nov. 7, 1997

§ 102(e) Date: Nov. 7, 1997

[87] PCT Pub. No.: WO97/34027

PCT Pub. Date: Sep. 18, 1997

[30] Foreign Application Priority Data

Mar. 13, 1996 [JP] Japan ..... 8-085832

[51] Int. Cl.[6] ..... C25B 3/00

[52] U.S. Cl. ..... 205/425

[58] Field of Search ..... 205/425

[56] References Cited

FOREIGN PATENT DOCUMENTS 48-78197 10/1973 Japan .
59-163387 9/1984 Japan .

*Primary Examiner*—Arun S. Phasge
*Assistant Examiner*—Edna Wong
*Attorney, Agent, or Firm*—Kubovcik & Kubovcik

[57] ABSTRACT

A process for preparing a 3-alkoxymethylcephem compound represented by the formula (II)

(II)

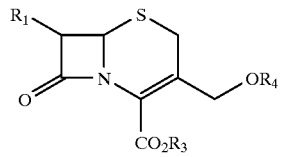

where $R_1$ is a hydrogen atom, amino or protected amino, $R_3$ is a hydrogen atom or carboxylic acid protective group and $R_4$ is lower alkyl, which process is characterized in that a 3-thiomethylcephem compound represented by the formula (I)

(I)

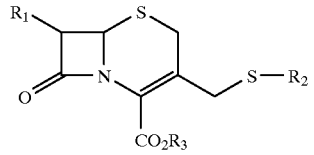

where $R_1$ and $R_3$ are as defined above and $R_2$ is aryl which may have a substituent, is electrolytically oxidized in an electrooxidation reaction system in the presence of a lower alcohol using as a positive electrode, a material selected from the group consisting of platinum, tin, aluminum, stainless steel, nickel, lead oxide, carbon, iron oxide and titanium, to obtain the 3-alkoxymethylcephem compound.

2 Claims, No Drawings

PROCESS FOR PREPARING 3-ALKOXYMETHYLCEPHEM COMPOUNDS

This is a national stage application of PCT/JP97100708 filed Mar. 7, 1997.

TECHNICAL FIELD

The 3-alkoxymethylcephem compounds are, for example, important intermediates of Cefpodoxime proxetil (see Handbook of Latest Antibiotics, 9th ed., Yakuho Jihosha Pub. Co. Ltd., 1994, pp. 84, 85, 87) generally in wide use and are compounds prevalently used industrially.

BACKGROUND ART

Conventionally 3-alkoxymethylcephem derivatives represented by the formula (II) are prepared by a common process disclosed in J. Antibiot., XL, 370(1987) and represented by the following reaction scheme, i.e., by reacting thionyl chloride with a 3-hydroxymethylcephem derivative to obtain a chloride, iodizing the chloride, and reacting the resulting iodide with an alcohol in the presence of mercury nitrate. This process requires the use of hazardous reagents such as thionyl chloride and mercury nitrate for the reactions and is in no way a practical process.

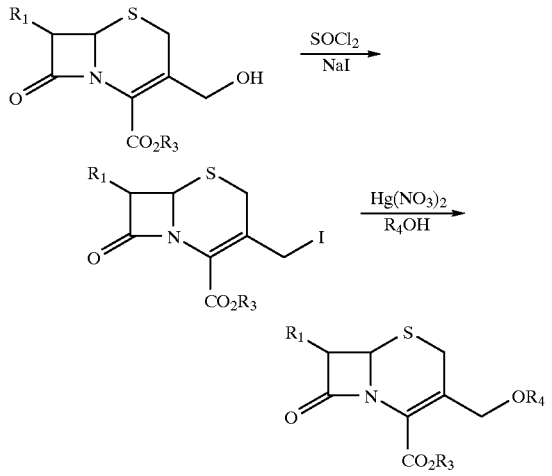

wherein $R_1$, $R_3$ and $R_4$ are the same as defined later.

J. Chem. Soc. PERKINTRANS. I, 2281(1983) and Helvetica Chimica Acta, 58, 2469(1975) disclose a process for preparing the derivative from a 3-brominated methylcephem compound or 3-fluorinated methylcephem compound by a substitution reaction in an alcohol, whereas this process is far from being feasible since the starting material, i.e., 3-brominated methylcephem compound or 3-fluorinated methylcephem compound itself is difficult to synthesize.

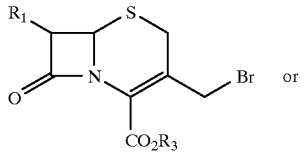

-continued

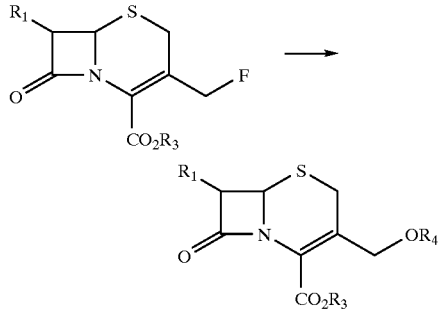

JP-A-36690/1977 discloses a process wherein a 3-hydroxymethylcephem derivative serving as the starting material is reacted with an alcohol with addition of an activating agent such as trifluoroacetic anhydride, whereas since the 3-hydroxymethylcephem derivative is used as the material, the process yields a large amount of lactone compound as a by-product through an intramolecular cyclization reaction if a compound other than 4-position carboxylic acids is used, and is therefore not an appropriate process. Moreover, the process is not useful practically because at least two equivalents of the expensive activating agent is required relative to the starting material.

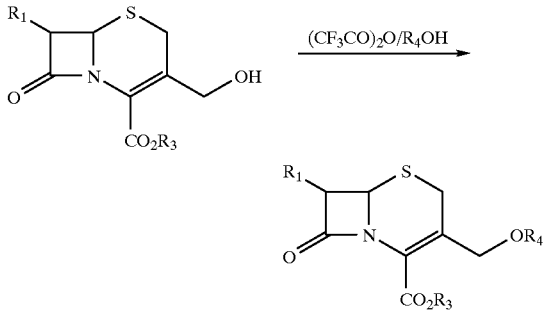

JP-A-49790/1990, JP-A-131181/1989 and JP-A-96091/1983 disclose a process for reacting a boric acid alkyl ester or alcohol with a 3-acyloxymethylcephem compound serving as the starting material in the presence of a Lewis acid. Similarly a report has been made on this reaction of alcohol as conducted in the presence of a Lewis acid and boron trifluoride compound. Presumably, however, difficulties will be encountered in industrially practicing these processes because of the necessity of using a large quantity of Lewis acid, or the need to use the boron compound which is expensive.

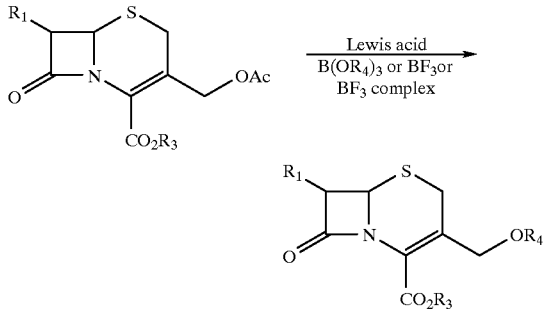

JP-A-163387/1984 discloses a process wherein this reaction is conducted with use of a sulfonic acid, but the yield is low to render the process infeasible. Although a report has been made on a process wherein the acetoxy group is iodized first, followed by a reaction with an alcohol (JP-A-192392/1982), the process requires a large amount of an iodine reagent and is difficult to practice on an industrial scale.

A report is also made on a process wherein the hydroxyl group of a 3-hydroxymethylcephem compound is alkylated with a diazomethane compound (JP-A-10873/1975). However, this process is far from being practical because of the need to use the diazo compound which is harmful to the human body and very hazardous.

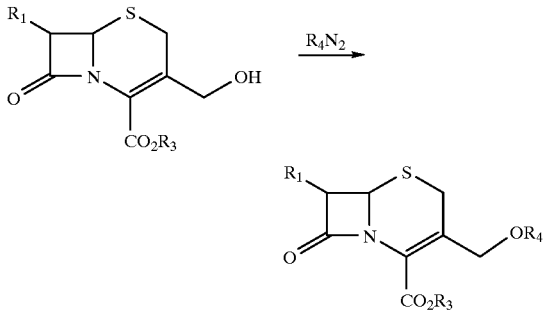

Thus, various processes have been developed in view of the low reactivity of alkyl alcohols, but none of them are practically useful, and it has been desired to develop more suitable processes.

An object of the present invention is overcome the drawbacks of the conventional processes described and to provide a process for producing the desired 3-alkoxymethylcephem derivative in a high yield and with a high purity.

DISCLOSURE OF THE INVENTION

The present invention provides a process for preparing a 3-alkoxymethylcephem compound represented by the formula (II) which process is characterized in that a 3-thiomethylcephem compound represented by the formula (I) is electrolytically oxidized in the presence of a lower alcohol to obtain the 3-alkoxymethylcephem compound. The 3-thiomethylcephem compound is represented by formula (I):

(I)

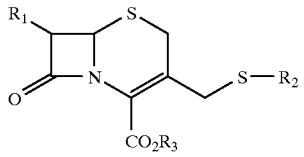

wherein $R_1$ is a hydrogen atom, amino or protected amino, $R_2$ is aryl which may have a substituent, and $R_3$ is a hydrogen atom or carboxylic acid protective group. The 3-alkoxymethylcephem compound is represented by formula (II):

(II)

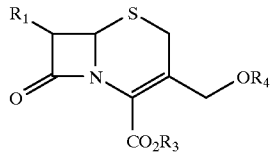

wherein $R_2$ and $R_3$ are as defined above, and $R_4$ is lower alkyl.

In developing a process for preparing 3-alkoxymethylcephem compounds, we have developed a novel activation method different from the method of activating the cephem C-3' position by introducing an expensive highly hazardous leaving group with high activity. More specifically, we have found the novel fact that the cephem C-3' position can be activated by introducing a thio substituent into the cephem C-3' position and thereafter electrolytically oxidizing the cephem compound, consequently permitting an alcohol of low nucleophilic property to undergo a substitution reaction smoothly.

According to the present invention, a compound represented by the formula (I) serving as the starting material is electrolytically oxidized in the presence of an alcohol, consequently affording a 3-alkoxymethylcephem derivative represented by the formula (II) in a single step with a high purity and in a high yield.

Examples of groups mentioned herein are as follows.

Exemplary of the protected amino represented by $R_1$ are amido groups such as phenoxyacetamido, p-methylphenoxyacetamido, p-methoxyphenoxyacetamido, p-chlorophenoxyacetamido, p-bromophenoxyacetamido, phenylacetamido, p-methylphenylacetamido, p-methoxyphenylacetamido, p-chlorophenylacetamido, p-bromophenylacetamido, phenylmonochloroacetamido, phenyldichloroacetamido, phenylhydroxyacetamido, thienylacetamido, phenylacetoxyacetamido, α-oxophenylacetamido, benzamido, p-methylbenzamido, p-methoxybenzamido, p-chlorobenzamido, p-bromobenzamido, phenylglycylamido, phenylglycylamido having protected amino, p-hydroxyphenylglycylamido, p-hydroxyphenylglycylamido having protected amino and/or protected hydroxyl, etc.; imido groups such as phthalimido, nitrophthalimido, etc., in addition to the groups disclosed in Theodora W. Greene, 1981, "Protective Groups in Organic Synthesis" (hereinafter referred to merely as the "literature"), Chap. 7 (pp. 218–287). Examples of protective groups for the amino of phenylglycylamido group and p-hydroxyphenylglycylamido group are those disclosed in the literature, Chap. 7 (pp. 218–287). Examples of protective groups for the hydroxyl of p-hydroxyphenylglycylamido group are those disclosed in the literature, Chap.2 (pp. 10–72).

Examples of aryl and substituted aryl represented by $R_2$ are phenyl, naphthyl, nitrogen-containing heterocyclic group, etc. Exemplary of the nitrogen-containing heterocyclic groups are pyridyl group, triazol group, thiazol group, tetrazol group, etc. Exemplary of the substituent which may be substituted in the aryl are halogen atoms (such as fluorine atom, chlorine atom, bromine atom, iodine atom), straight-chain or branched $C_{1-4}$ alkoxyl groups (such as methoxy, ethoxy), straight-chain or branched $C_{1-4}$ alkylthio groups (such as methylthio, ethylthio), straight-chain or branched $C_{1-4}$ alkylsulfonyloxy groups (such as methanesulfonyloxy, trifluoromethanesulfonyl-oxy), aromatic sulfonyloxy or substituted aromatic sulfonyloxy (such as benzenesulfonyloxy, toluenesulfonyloxy), straight-chain or branched $C_{1-4}$ alkyl groups (such as methyl, ethyl), amino, amino which has as a substituent one or two straight-chain or branched $C_{1-4}$ alkyl groups (such as methylamino, dimethylamino, ethylamino, diethylamino), hydroxyl, acyloxy group represented by R'COO— wherein R' is phenyl, tolyl, or straight-chain or branched $c_{1-4}$ alkyl group (such as phenylcarbonyloxy, acetyloxy), acyl group represented by R'CO— wherein R' is as defined above (such as phenylcarbonyl, acetyl), nitro, cyano, phenyl, etc. When the aryl represented by $R_2$ is phenyl group, the aryl may have 1 to 5, especially 1, 2 or 3, same or different groups selected from among the above substituents. When the aryl represented by $R_2$ is naphthyl group, the aryl may have 1 to 7, especially 1, 2 or 3, same or different groups selected from among the above substituents.

Exemplary of the carboxylic acid protecting group represented by $R_3$ are allyl, benzyl, p-methoxybenzyl, p-nitrobenzyl, diphenylmethyl, trichloromethyl, tert-butyl, and those disclosed in the literature, Chap. 5 (pp. 152–192).

The 3-thiomethylcephem compound represented by the formula (I) for use as a starting material of the present invention can easily be prepared, for example, by substituting a halogen atom of a 3-chloromethylcephem compound represented by the formula (III) with an arylthiol compound represented by the formula (IV)

(III)

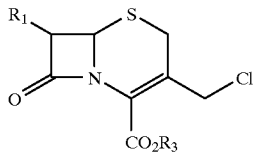

wherein $R_1$ and $R_3$ are as defined above $$R_2SH \quad \text{(IV)}$$

wherein $R_2$ is as defined above.

The reaction is conducted in a suitable solvent. Examples of solvents useful in the reaction are lower alkyl esters of lower carboxylic acids such as methyl formate, ethyl formate, propyl formate, butyl formate, methyl acetate, ethyl acetate, propyl acetate, butyl acetate, methyl propionate and ethyl propionate, ketones such as acetone, methyl ethyl ketone, methyl propyl ketone, methyl butyl ketone, methyl isobutyl ketone and diethyl ketone, ethers such as diethyl ether, ethyl propyl ether, ethyl butyl ether, dipropyl ether, diisopropyl ether, dibutyl ether, methyl cellosolve and dimethoxyethane, cyclic ethers such as tetrahydrofuran, dioxane and dioxolan, nitriles such as acetonitrile, propionitrile, butyronitrile, isobutyronitrile and valeronitrile, substituted or unsubstituted aromatic hydrocarbons such as benzene, toluene, xylene, chlorobenzene and anisole, hydrocarbon halides such as dichloromethane, chloroform, dichloroethane, trichloroethane, dibromoethane, propylene dichloride, carbon tetrachloride and freons, aliphatic hydrocarbons such as pentane, hexane, heptane and octane, cycloalkanes such as cyclopentane, cyclohexane, cycloheptane and cyclooctane, amides such as dimethylformamide, diethylformamide and dimethylacetamide, cyclic amides such as N-methylpyrrolidinone, dimethylsulfoxide, etc. These solvents are used singly or in admixture of at least two of them. These solvents may contain water as required. These solvents are used in an amount of about 10 to about 200 liters, preferably about 20 to about 100 liters, per kilogram of the compound of the formula (III). The reaction is conducted usually at −78° C. to 150° C., preferably 0° C. to 60° C. The reaction can be conducted as required in the presence of a base. Examples of useful bases are hydroxides, carbonates or bicarbonates of alkali metals or alkaline earth metals such as potassium, sodium, lithium, magnesium and calcium; molecular sieves and polyvinylpyridine. The base can be used in the form of a solid. Further, organic tertiary amines are also usable. Examples thereof are N,N,N-tri lower alkyl amines such as trimethylamine, dimethylethylamine, triethylamine and diisopropylethylamine, N-lower alkyl azacycloalkanes such as N-methylpiperidine and N-ethylpiperidine, N-lower alkyl azaoxycycloalkanes such as N-methylmorpholine and N-ethylmorpholine, N-phenyl lower alkyl-N,N-di lower alkyl amines such as N-benzyl-N,N-dimethylamine and N-benzyl-N,N-diethylamine, N,N-dialkyl aromatic amines such as N,N-dimethylaniline, nitrogen-containing aromatic amines such as pyridine, bicycloamines such as diazabicycloundecene and diazabicyclononene, and a mixture of these amines. These bases are used usually in an amount of 1 to 10 equivalents based on the β-lactam compound of the formula (III). When required, it is recommended the base is added until the β-lactam compound of the formula (III) is consumed. The resulting 3-thiomethylcephem compound of the formula (I) can be isolated by the usual purification method but can be used in the next reaction without purification.

The 3-thiomethylcephem compound thus obtained of the formula (I) is subjected to an electrolytic oxidation reaction in the presence of a lower alkyl alcohol to produce a 3-alkoxymethylcephem compound of the formula (II).

In carrying out the electrolytic reaction of the present invention, a supporting electrolyte is added to the reaction system as required. Examples of useful supporting electrolytes are metal perchlorate salts such as lithium perchlorate, sodium perchlorate and magnesium perchlorate, ammonium perchlorate salts such as ammonium perchlorate, tetraethylammonium perchlorate and tetrabutylammonium perchlorate, ammonium sulfate salts such as tetrabutylammonium tosylate, ammonium halide salts such as ammonium chloride, ammonium bromide, ammonium iodide, tetraethylammonium chloride and tetrabutylammonium bromide, metal borofluoride salts such as lithium borofluoride and sodium borofluoride, ammonium borofluoride salts such as tetraethylammonium borofluoride and tetrabutylammonium borofluoride, amines such as triethylamine, collidine, lutidine, pyridine, piperidine, N-methylmorpholine, 1,5-diazabicyclo[3,4,0]nonene-5 (DBN) and 1,5-diazabicyclo[5,4,0]undecene-5 (DBU), carboxylic acids such as acetic acid, monochloroacetic acid and trifluoroacetic acid, etc. These support electrolytes are used singly or in the form of a mixture of at least two of them. Preferable to use are the ammonium perchlorate salt, ammonium sulfate salt and ammonium borofluoride salt. The support electrolyte is used usually in an amount of about 0.1 to about 100 wt. %, preferably about 0.1 to about 50 wt. %, based on the solvent.

A wide variety of electrodes useful for usual electrolytic reactions are usable for the electrolytic oxidation process of the present invention. For example, platinum, tin, aluminum, stainless steel, nickel, lead oxide, carbon, iron oxide, titanium, etc. are usable as materials for the positive electrode, and platinum, tin, aluminum, stainless steel, zinc, lead, copper, carbon, etc. as materials for the negative electrode. It is preferable to use platinum, carbon and stainless steel for the positive electrode.

It is likely that the electrolytic oxidation of the invention will be effected with an improved reaction efficiency by adding to the electrolytic system an additive other than the above support electrolyte. Examples of such additives usable are alkali metal sulfates such as sodium sulfate and potassium sulfate, alkaline earth metal sulfates such as magnesium sulfate and calcium sulfate and silyl compounds such as N,O-bistrimethylsilylacetamide and N,N'-bistrimethylsilylurea. If the additive is used, the supporting electrolyte need not always be used as the case may be.

Examples of useful solvents for the above reaction are the same as those for use in the reaction for preparing the compound of the formula (I).

The electrooxidation of the present invention is characterized in that this process can be practiced within a single cell without a need to separate the positive electrode from the negative electrode although the electrodes can be separated by a partition membrane. The reaction temperature is usually in the range of −78° C. to 60° C., preferably −40° C. to 30° C.

The present reaction can be carried out either at a constant current or at a constant voltage. However, it is desirable to use the constant current electrolysis process in view of the simplicity of the device and procedure. While the electrolysis can be effected with direct current or alternating current, it is also possible to conduct the reaction by changing the direction of current every second or every 30 seconds. The current density is usually 1 to 500 mA/cm$^2$, preferably 1 to 50 mA/cm$^2$. The quantity of electricity to be used is usually 2 to 10 F/mole, preferably 2 to 5 F/mole although the quantity varies with the shape of the electrolytic cell, the kind of the starting compound (I) and the kind of solvent used and can not therefore be determined specifically. The reaction is completed by passing the abovementioned quantity of electricity.

BEST MODE OF CARRYING OUT THE INVENTION

The present invention will be described in detail with reference to the following examples, in which Me stands for methyl, Et for ethyl, Ph for phenyl and Ts for tosyl.

EXAMPLE 1

A 150 mg quantity of compound (I) ($R_1$=$PhCH_2CONH$, $R_2$=3,5-di-t-butyl-4-hydroxyphenyl-1-yl, $R_3$=$CH_2C_6H_4OCH_3$-p), 50 mg of tetra-n-butyl ammonium tetrafluoroborate and 50 mg of magnesium sulfate were weighed out into a 20 ml branched test tube and stirred with addition of 5 ml of acetonitrile and 1 ml of methanol to prepare a solution. With two platinum electrodes (15 mm×20 mm) installed in the solution, electricity was passed through the solution in a quantity of 4 F/mol at a current density of 10 mA/cm$^2$. The reaction mixture was poured into 1N hydrochloric acid, followed by extraction with ethyl acetate. The extract was washed with water twice and then with brine once, and thereafter dried over anhydrous sodium sulfate. The resulting extract was evaporated at a reduced pressure to remove the solvent, and the residue was purified by silica gel column chromatography, giving a compound (II) (80 mg, 80%).

$^1$H-NMR ($CDCl_3$) d 3.26 (s,3H), 3.45 (s,2H), 3.62, 3.66 (ABq, J=12 Hz, 2H), 3.80(s,3H), 4.24(s,2H), 4.91(d, J=4 Hz, 1H), 5.18(s,2H), 5.80(dd, J=4.6 Hz, 1H), 6.04(d, J=6 Hz, 1H) 6.86–7.40(m, 9H).

EXAMPLES 2 TO 8

The similar reactions to that of Example 1 were conducted except that a support electrolyte was changed. Table 1 shows the results.

EXAMPLES 9 TO 14

The similar reactions to that of Example 1 were conducted except that an electrode was changed. Table 2 shows the results.

EXAMPLES 15 TO 18

The similar reactions to that of Example 1 were conducted except that an additive was changed. Table 3 shows the results.

EXAMPLES 19 TO 23

The similar reactions to that of Example 1 were conducted except that a solvent was changed. Table 4 shows the results.

TABLE 1

| Ex. | support electrolyte | yield (%) |
|---|---|---|
| 2 | $Et_4NClO_4$ | 80 |
| 3 | $LiClO_4$ | 75 |
| 4 | $Et_4NCl$ | 78 |
| 5 | $Et_4NOTs$ | 76 |
| 6 | $LiBF_4$ | 78 |
| 7 | $Et_4NBr$ | 72 |
| 8 | $MgClO_4$ | 70 |

TABLE 2

| Ex. | cathode | anode | yield (%) |
|---|---|---|---|
| 9 | Pt | C | 78 |
| 10 | Pt | Cu | 78 |
| 11 | Pt | SUS | 75 |
| 12 | C | C | 70 |
| 13 | C | Pt | 72 |
| 14 | C | Cu | 70 |

TABLE 3

| Ex. | additive | yield (%) |
|---|---|---|
| 15 | None | 75 |
| 16 | $CaSO_4$ | 78 |
| 17 | $Na_2SO_4$ | 78 |
| 18 | $K_2SO_4$ | 79 |

TABLE 4

| Ex. | solvent | yield (%) |
|---|---|---|
| 19 | MeOH | 70 |
| 20 | $CH_2Cl_2$/MeOH (5/1) | 72 |
| 21 | $CH_3CO_2Et$/MeOH (5/1) | 70 |
| 22 | THF/MeOH (5/1) | 74 |
| 23 | dioxane/MeOH (5/1) | 73 |

REFERENCE EXAMPLE 1

The following shows a synthetic route of Cefpodoxime proxetil from 3-alkoxymethylcephem compound of the invention.

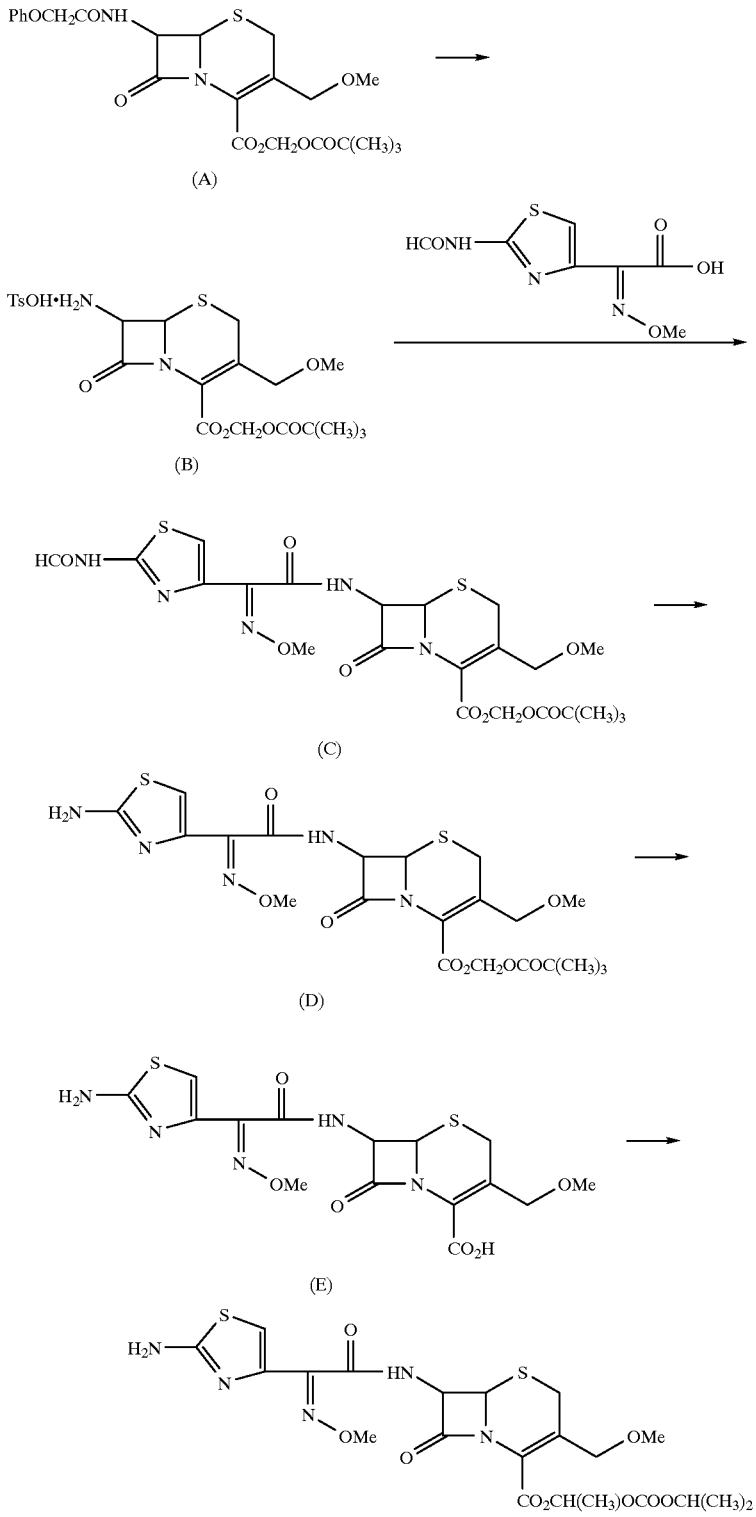

Cefpodoxime proxetil

Literature for reference (J. Antibiotics, XL, 372, 1987)

Industrial Applicability

According to the present invention, a 3-thiomethylcephem compound represented by the formula (I) serving as the starting material is electrolytically oxidized in the presence of a lower alcohol, consequently affording a 3-alkoxymethylcephem compound represented by the formula (II) in a simple procedure stably in a high yield and with a high purity.

We claim:

1. A process for preparing a 3-alkoxymethylcephem compound represented by the formula (II)

(II)

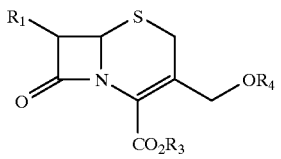

where $R_1$ is a hydrogen atom, amino or protected amino, $R_3$ is a hydrogen atom or carboxylic acid protective group and $R_4$ is lower alkyl, which process is characterized in that a 3-thiomethylcephem compound represented by the formula (I)

(I)

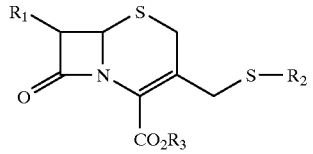

where $R_1$ and $R_3$ are as defined above and $R_2$ is aryl which may have a substituent, is electrolytically oxidized in an electrooxidation reaction system in the presence of a lower alcohol using as a positive electrode, a material selected from the group consisting of platinum, tin, aluminum, stainless steel, nickel, lead oxide, carbon, iron oxide and titanium, to obtain the 3-alkoxymethylcephem compound.

2. A process as defined in claim 1 wherein a supporting electrolyte is added to the electrooxidation reaction system.

* * * * *